United States Patent [19]

Peugh

[11] Patent Number: 4,856,438

[45] Date of Patent: Aug. 15, 1989

[54] FURNACE

[76] Inventor: Dean Peugh, 5156 Harlan Dr., Klamath Falls, Oreg. 97603

[21] Appl. No.: 167,554

[22] Filed: Mar. 14, 1988

[51] Int. Cl.[4] ..... F23B 7/00

[52] U.S. Cl. ..... 110/233; 110/110; 110/322; 110/326

[58] Field of Search ..... 110/110, 286, 322, 323, 110/326, 324, 233

[56] References Cited

U.S. PATENT DOCUMENTS

| | | | |
|---|---|---|---|
| 2,034,890 | 3/1936 | Wynn | 110/45 |
| 2,067,583 | 1/1937 | Stark | 198/64 |
| 4,323,017 | 4/1982 | Harris | 110/110 |
| 4,385,566 | 5/1983 | Harris | 110/110 |
| 4,426,937 | 1/1984 | Sietmana et al. | 110/322 X |
| 4,565,184 | 1/1986 | Collins et al. | 126/368 |
| 4,619,209 | 10/1986 | Traeger et al. | 110/110 |

OTHER PUBLICATIONS

Brochure from Alternative Energy Northwest, Inc., *Turbo * Fire Pellet Stove the Trend Setter.*

Brochure from Pyro Industries, *Whitfield Rediscovers Fire.*

Brochure from Convector Stoves, Inc., *Convector Pellet Stove 'For Those Who Want the Very Best'.*

Cheryl M. Fiorillo, *Wood Wood Stove,* Feb. 1988 edition of Popular Science, p. 31.

Pamphlet from Welenco Mfg., Inc. *Welenco At Last.*

Pamphlet from Traeger Industries, *Traeger BioMass Products Stoves & Furnaces.*

*Primary Examiner*—Edward G. Favors

*Attorney, Agent, or Firm*—Garrison and Stratton P.S.

[57] ABSTRACT

The present invention is a furnace for burning pelletized or particulate fuel. The furnace has a split auger located within a serpentine fuel conduit which controllably feeds pelletized fuel into a contained burner, wherein the fuel is exposed to fire and a forced air plenum. The fuel is contained within the burner and exposed to high temperatures until the fuel is sufficiently burnt to pass through apertures in a perforated baffle. Further combustion is achieved by passing the heated combustible gases through multiple combustion chambers. A heat exchanger passes air by the multiple combustion chambers, thereby collecting the produced heat, and distributes the heated air into residential or commercial air circulation systems.

15 Claims, 4 Drawing Sheets

FURNACE

TECHNICAL FIELD

This invention relates to a furnace which burns pelletized or particulate fuel. More specifically, the present invention relates to a combustion furnace having a split auger located within a serpetine fuel conduit which controllably feeds pelletized fuel from a fuel supply storage bin into a burner wherein the fuel is burnt below a perforated baffle. To assist combustion, a substantial region within the burner is exposed to a forced air plenum, and the partially combusted gases are passed through multiple combustion chambers before being passed to the outside atmosphere. Heat is collected and distributed by forcing air to circulate past the multiple combustion chambers located within a heat exchanger.

BACKGROUND ART

Within the residential and commercial heating industry there has been a great need to increase the efficiency of pelletized fuel burning furnaces. Numerous furnaces, created in an attempt to meet that need, have been disclosed in issued patents.

Wynn (U.S. Pat. No. 2,034,890) discloses a stoker having a vertically disposed cylindric chamber into which fuel is fed. The stoker cylinder is surrounded by an air chamber with a tuyere cover. The tuyere cover has a plurality of openings for discharging air into a combustion chamber. A separate conduit feeds air from a fan to the air chamber.

Stark (U.S. Pat. No. 2,067,583) discloses a stoker which feeds coal particles into a furnace box. Air for combustion is blown by a fan through twyers or orifices in a housing surrounding a combustion area.

Harris (U.S. Pat. Nos. 4,323,017 and 4,385,566) disclose various burner apparatus into which pelletized wood waste is fed from a hopper through a conduit by an auger screw. The screw is housed in a fuel supply conduit. Forced air is delivered through a tube to a plurality of apertures in the bowl of the burner.

Collins et al. (U.S. Pat. No. 4,565,184) describes a heater in which particulate fuel is fed by an auger to a retort. Air entering through a delivery tube passes into the retort through discharge openings located within the periphery of the retort manifold to support primary combustion. Secondary air is supplied through another set of discharge openings from an auxiliary manifold.

These disclosures are believed to illustrate the general scope of the prior art related to pelletized or particulate fuel burning furnaces. The applicant submits that these disclosures, taken alone or together, do not teach the combination of concepts embodied in this invention.

DISCLOSURE OF INVENTION

It is the general object of the present invention to provide a furnace capable of effectively and continuously producing heat for heating residential or commercial buildings.

It is a further object of the present invention to provide a furnace capable of burning substantially all of the pelletized or particulate fuel it is fed.

A still further object of the present invention is to provide a furnace wherein the fuel is burnt at a high combustion temperature.

Another object is to provide a fuel conveying means having a split auger located within a serpentine fuel conduit, whereby combustion is prevented from traveling through the fuel conveying means into a fuel supply storage bin.

Another object is to provide a furnace which retains the combustible, particulate fuel within a burner below a perforated, conical baffle until the fuel becomes heat, combustible gases, exhaust, or ash.

Another object of the present invention is to provide a furnace wherein a substantial region within a burner is exposed to a forced air plenum which supplies air for combustion at a location substantially below the perforated baffle which is set upon the open upper end of the burner.

Another object is to provide a furnace having multiple combustion chambers wherein substantially all combustive portions of the fuel and its combustible gases are oxidized.

Another object is to provide a furnace having a heat exchanger for collecting heat from the furnace and distributing heated air to conventional heating ducts for residential or commercial spatial heating.

The furnace of the present invention may be used as an auxiliary heater or as the primary heat source for supplying spatial heat to residential or commercial building. The scale of the furnace can vary considerably, depending upon the intended use of the furnace. The furnace is capable of continuously and efficiently oxidizing pelletized or particulate fuel, including its gaseous by-products, collecting the produced heat, and then distributing the heat to conventional heat distribution systems. More specifically, the present invention uses a variety of features including a specially designed burner, fuel conveying means, air supplying means, secondary combustion structure, and heat exchanger to achieve the above-mentioned objects.

A furnace made in accordance with this invention is capable of safely conveying large quantities of combustible, solid, pelletized or particulate fuel through the fuel conveying means into the burner. The fuel conveying means uses an inclined auger located in an inclined conduit to transport the fuel from the bottom of a fuel supply storage bin to an elevated level, where the fuel falls through a vertical safety tube. The fuel is then transferred from the base of the safety tube by a horizontal auger through a horizontal conduit into the burner. The fuel is retained within the burner below a perforated baffle, and is exposed to an intense flame supported by the injection of air into the burner until substantially all solid particles are effectively oxidized at high combustion temperatures. A controlled fuel and air supply, the use of tuyeres located substantially below the upper end of the burner, and the use of the perforated baffle or retaining cap which is attached to the top of the burner, each contribute to produce the high combustion temperatures which ensure all solid fuel particles are consumed within the burner.

The burner is a cylindrical burning chamber having an inclined floor to force the fuel upward into a primary burning zone. The burner has a tuyere ring which is located below a retaining ring. A perforated baffle is attached to the retaining ring to partially enclose the top of the burner. An air supply manifold is coaxially positioned around the burner. A delivery tube, communicating with the air supply manifold, is coaxially positioned around the horizontal conduit. An elevated, pressurized air plenum is created within the delivery tube and air supply manifold by a combustion air blower which is attached to the delivery tube. As used herein, the air plenum is defined as a condition in which the pressure of the air in an enclosed space is greater than that of the outside atmosphere. The air plenum causes the air to be forced through a plurality of tuyeres located in the tuyere ring to pass into the interior, primary burning zone of the burner. The retaining ring is located above the tuyere ring, thereby extending the depth of the primary burning zone. The shallow draft, conical, perforated baffle is placed upon the top of the retaining ring. The baffle has a plurality of perforations, preferably in the form of pie shaped openings, which permit heat, partially combusted gases, and exhaust to exit the burner, and allow ash to spill over and out of the burner. The perforated baffle also functions to retain the burning fuel within the primary burning zone and elevate the temperatures within the primary burning zone. The elevated temperatures in the primary burning zone, induced in part by the perforated baffle, results in more nearly complete combustion of the pelletized fuel. The baffle further serves to contain the combustible solids within the primary burning zone of the burner, permitting only the ash, heat, exhaust, and combustible gases to exit. The baffle thereby significantly increases the combustion temperatures and efficiency of burning.

The gaseous by-products resulting from the combustion of the fuel may then be passed into a serpentine secondary combustion structure having multiple combustion chambers wherein the combustible gases are further oxidized through one or more additional stages. The secondary combustion structure of the preferred embodiment includes a primary combustion chamber, a secondary combustion chamber, and possibly even a tertiary combustion chamber, each being adapted to further oxidize the combustible gases prior to the release of the exhaust to the atmosphere. The burner is located within the primary combustion chamber. The successive combustion chambers are interconnected by flue pipes which are positioned to require the combustible gases to pass substantially through the length of each successive combustion chamber. The remaining waste exhaust is expelled from the uppermost combustion chamber into a chimney and out of the associated building. Substantial oxidation of all solid fuel particles and gaseous by-products increase the fuel efficiency of the furnace by maximizing the thermal value obtained from the material being burnt. Substantial oxidation of these elements also reduces the amount of emitted air pollutants being expelled from the furnace.

BEST MODE FOR CARRYING OUT THE INVENTION

Figure 1:
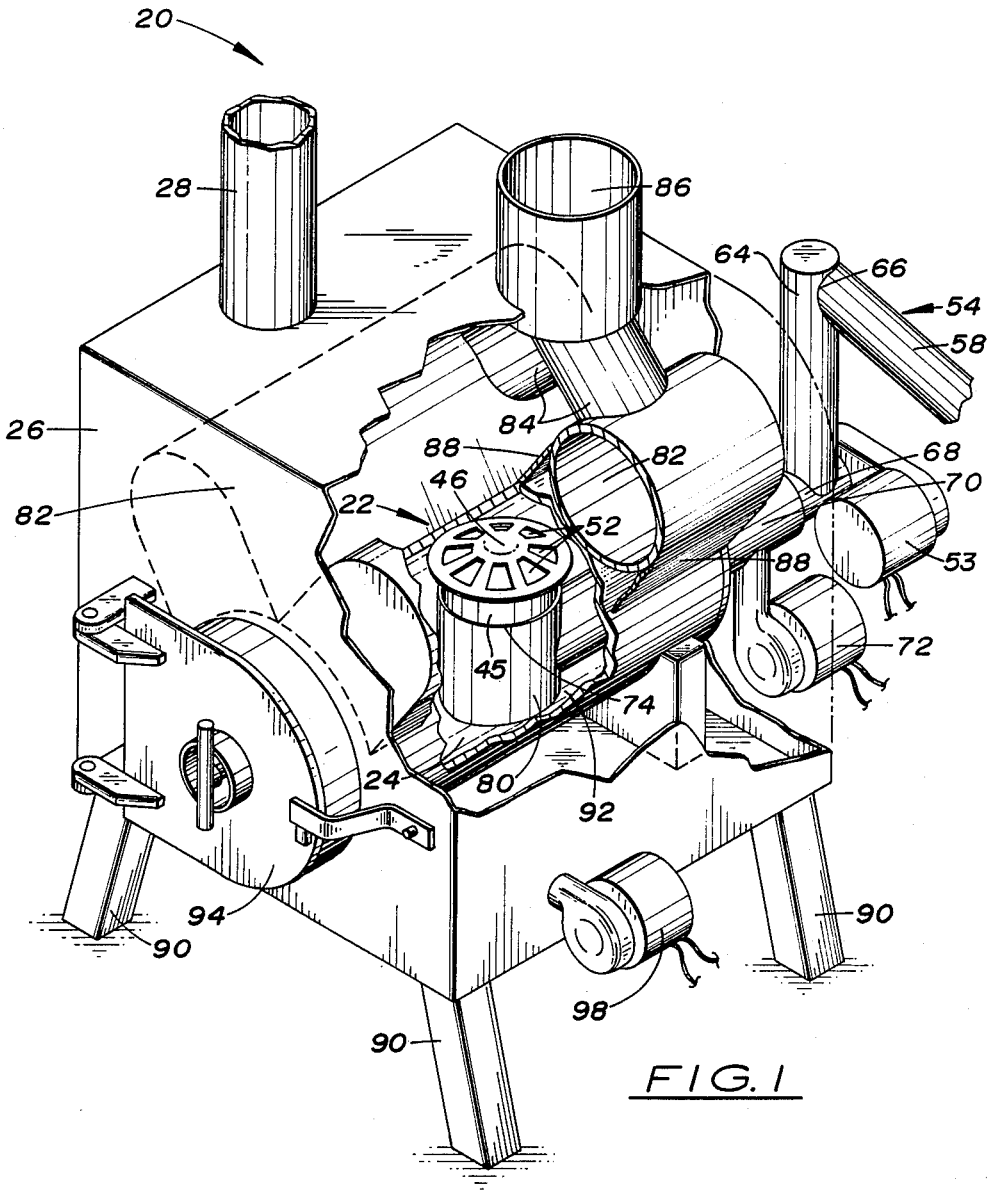
FIG. 1 is a perspective view of the preferred embodiment of the furnace made in accordance with this invention.

Referring to the drawings, wherein like numerals indicate like parts, furnace 20 comprises a specially designed burner 22 located within a secondary combustion structure. Burner 22 defines a primary burning zone wherein pelletized fuel particles are burnt. The secondary combustion structure defines a secondary combustion zone wherein the combustible gaseous by-products of the fuel are further oxidized before the remaining exhaust is expelled to the outside atmosphere. The secondary combustion structure has at least a primary combustion chamber 24 wherein burner 22 is located. A heat exchanger 26 may be used to enclose the secondary combustion structure and collect the heat therefrom. Air is forced between the walls of heat exchanger 26 and the secondary combustion structure to absorb the heat caused by the oxidation of the fuel. The heated air is then passed to a heat duct 28 where it may be passed into a conventional heat distribution system.

Figure 5:
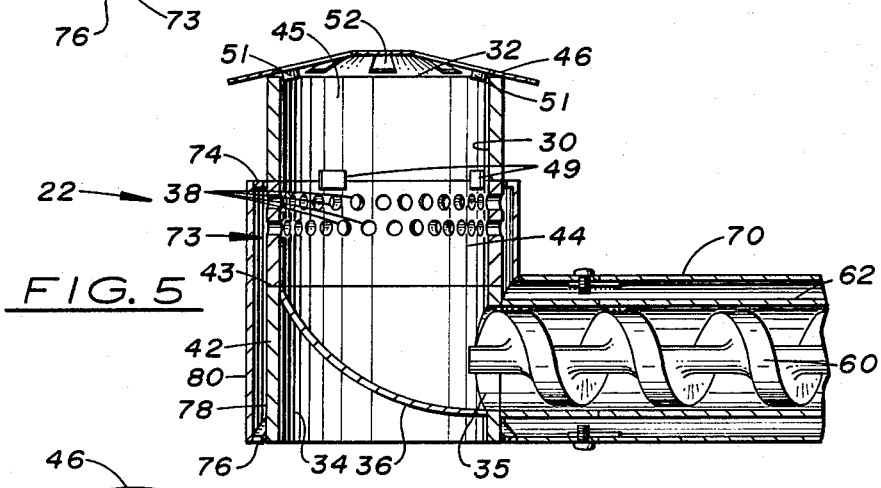
FIG. 5 is a cross-sectional view of the burner taken along line V—V of FIG. 6.
Figure 6:
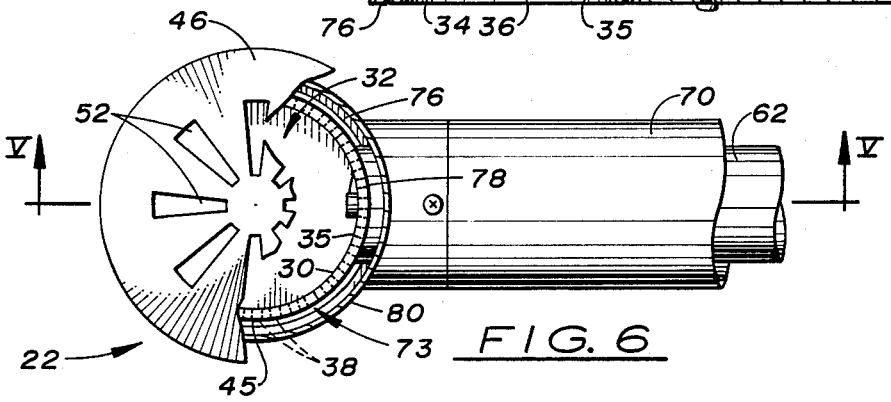
FIG. 6 is a plan view of the burner with a portion of the perforated baffle broken away.
Figure 7:
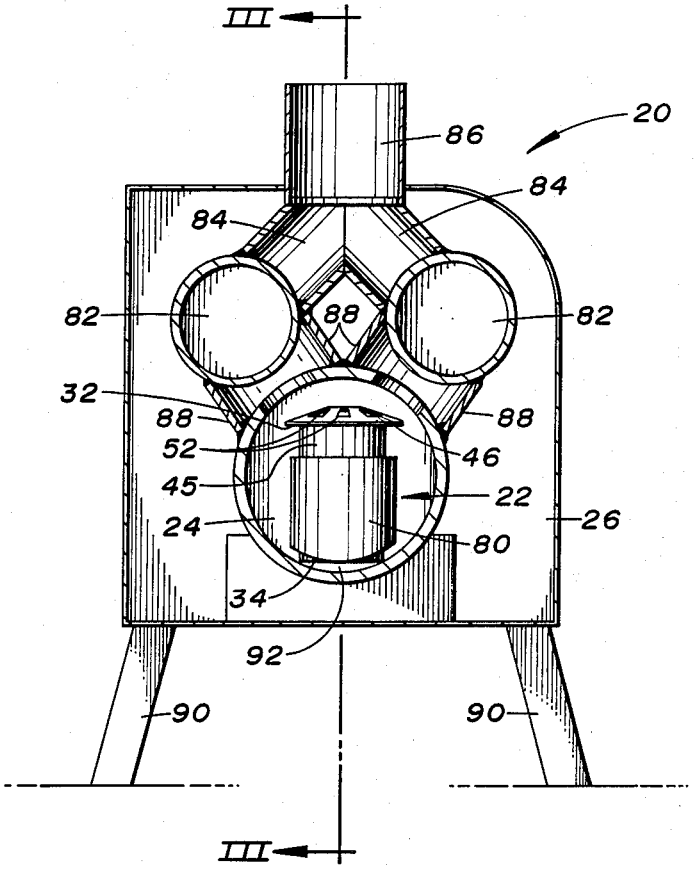
FIG. 7 is a cross-sectional view of the apparatus taken along line VII—VII of FIG. 2.

Burner 22 receives fuel from a fuel conveying means and serves as a receptacle or retort wherein the pelletized fuel is burnt at elevated combustion temperatures. Burner 22 may be an upright, elongated cylinder, but is not limited to a cylindrical shape, since its shape may be altered without impairing its function as herein described. As shown in FIGS. 5 and 6, the interior side walls 30 of burner 22 may comprise bare metal or may be covered with firebrick or other appropriate refractory material. Interior side walls 30 extend from an open upper end 32 to a lower bottom end 34 of burner 22.

The fuel conveying means supplies particulate or pelletized fuel to burner 22. The fuel is delivered to the primary burning zone through a fuel receiving opening 35 which is located near the bottom end 34 of burner 22. A curved fuel baffle 36 is provided to direct incoming fuel upward into the vertically oriented burner 22. Fuel baffle 36 may comprise a directional, inclined or curved floor positioned on bottom end 34 which seals bottom end 34 and directs the fuel upward into the primary burning zone. In the preferred embodiment, fuel baffle 36 comprises a curved metal floor having a thickness of about one-eighth of an inch. Alternatively, fuel baffle 36 may comprise a formed elbow joint communicating with bottom end 34 of burner 22.

An air supplying means provides a continuous, controlled, forced combustion air plenum which vents through tuyeres 38 into the interior of burner 22, thereby supplying the burning fuel with an adequate air supply to support and enhance combustion within the primary burning zone. The controlled supply of air is injected into the interior cavity or primary burning zone of burner 22 through a plurality of tuyeres 38 which are positioned substantially below open upper end 32. The large but controlled volume of air includes a high content of naturally occurring oxygen. As shown best in FIG. 5, tuyeres 38 are located at a mid-level along interior side walls 30 so that the injected air must pass upwardly a substantial distance and pass through a substantial depth of burning fuel before it could escape upwardly from burner 22. The injected air enhances fuel combustion which occurs above and at the same level as tuyeres 38. Likewise, a greater amount of contained fuel is exposed for a longer period of time to the intense heat found within the primary burning zone, which is sustained by the injected air.

Figure 4:
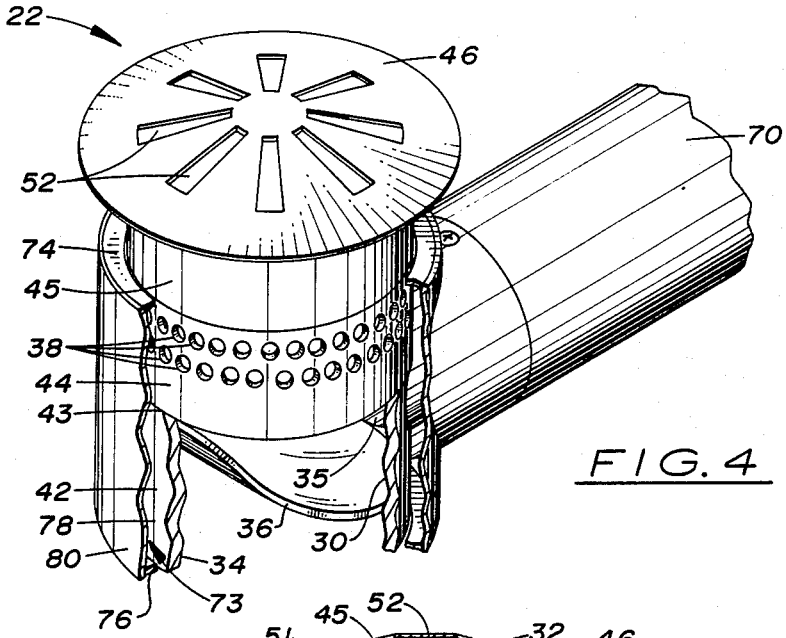
FIG. 4 is a perspective view of the burner.

In the preferred embodiment, as best seen in FIGS. 4, 5, and 6, burner 22 comprises three individual cylindrical lengths of pipe attached together to form approximately a ten-inch length of about a six-inch diameter pipe having about one-fourth inch wall thickness. The lowermost length of the pipe, referred to as base ring 42, is approximately six inches long and includes lower bottom end 34 and fuel receiving opening 35. Base ring 42 is preferably made of mild steel, as are the rest of the elements of furnace 20 with the exception of a tuyere ring 44, a retaining ring 45, and a perforated baffle 46, which are preferably made of stainless steel or other heat and oxidation resistant material.

The next and middle length of pipe, referred to as tuyere ring 44, is approximately two inches long, and is preferably made of stainless steel to resist corrosion caused by the intense heat within burner 22. Tuyere ring 44 is attached directly to the top of base ring 42 at weld 43. A plurality of tuyeres 38 through which combustion air may be injected into the primary burning zone of burner 22 are located around the periphery of tuyere ring 44. Preferably, there are two rows of tuyeres 38 spaced radially around the circumference of tuyere ring 44 on about one-half-inch centers. Each tuyere 38 has a diameter of about one-fourth inch. Air enters burner 22 through tuyeres 38 from an air supply manifold which surrounds tuyere ring 44.

The uppermost length of pipe, referred to as retaining ring 45, is approximately two inches long and includes open upper end 32. Retaining ring 45 is also made of stainless steel, but does not have any tuyeres located therein. Retaining ring 45 extends the height of the primary burning zone. A plurality of locating and retaining tabs 49 are attached to the bottom interior surface of retaining ring 45 to coaxially locate and position retaining ring 45 for operation upon tuyere ring 44.

A conical, perforated baffle 46 is removably attached to the upper end of retaining ring 45 which defines upper end 32 of burner 22. Perforated baffle 46 retains the combustible fuel solids which reach upper end 32, which significantly increases the combustion temperatures within burner 22. The increased combustion temperatures are due in part to the reflection of heat energy which is directed back into the primary burning zone by perforated baffle 46. As a result, the elevated combustion temperatures increase the efficiency of furnace 20 by causing the more complete burning of the fuel within burner 22. In the preferred embodiment, perforated baffle 46 is removably attached to the uppermost portions of retaining ring 45. Baffle tabs 51 may be used to center perforated baffle 46 on top of retaining ring 45. Perforated baffle 46 is preferably made from a stainless steel sheet having a thickness of about one-eighth inch. Perforated baffle 46 preferably has a shallow draft with the conical shape having a height of about two-and-one-half inches. Perforations 52 in perforated baffle 46 are preferably pie-shaped openings which permit ash, heat, exhaust, and partially combusted gases to exit from the interior of burner 22. Perforations 52 have a narrow width of about one-fourth inch and a wide width of one-half inch. Perforated baffle 46 also has an overhang which directs the expelled ash to fall away from burner 22.

The rate at which fuel is fed into a burner significantly affects the efficiency of the associated furnace. The fuel supply rate should be set such that all solid fuel particles are consumed before exiting the burner. If the fuel feeding rate is too slow, fuel within the burner could burn at a lower temperature and less heat would be produced. If the fuel feeding rate is too fast, incoming fuel may smother the flame. If the fuel is not completely consumed within the burner, the unconsumed fuel might be pushed out of the top of the burner by the incoming fuel only to become extinguished or remain burning at greatly reduced temperatures. The frequency of servicing the furnace to remove the substantial build up of ash and unconsumed fuel deposited therein is also increased. Consequently, a fuel supply rate which is too slow or too fast decreases the combustion efficiency. This invention overcomes these problems.

The fuel conveying means of the present invention is a positive drive mechanism which conveys fuel at a metered or regulated rate into burner 22 through fuel receiving opening 35. The fuel conveying means may be driven by a metered drive 53 which can be selectively controlled to match the burn rate of fuel being burnt within burner 22, or adjusted to maintain a desired temperature range.

The fuel conveying means comprises a split, powered, rotating auger located within a serpentine fuel conduit 54. The auger includes an inclined auger 56, located within an inclined conduit 58, and a horizontal auger 60, located within a horizontal conduit 62. A vertically oriented safety tube 64, not having an auger located therein, connects inclined conduit 58 and horizontal conduit 62. In the preferred embodiment, inclined auger 56 and horizontal auger 60 each have a two-inch diameter. The lower end of inclined conduit 58 is located within a fuel hopper or fuel supply storage bin. The fuel supply storage bin may be located near furnace 20 or at a remote location, depending upon the length and conveying capability of the fuel conveying means. Pelletized or particulate fuel, such as sawdust pellets, wood chips, or coal particles, are deposited by gravity from the fuel supply storage bin onto an extension of inclined auger 56 which is exposed to the falling fuel located within the fuel supply storage bin. Rotation of inclined auger 56 transports the fuel upwardly within inclined conduit 58 until the fuel is dropped through the vertically oriented safety tube 64.

Safety tube 64 connects the uppermost end 66 of inclined conduit 58 and the feeding end 68 of horizontal conduit 62. Safety tube 64 provides a safety zone or fire break to prevent fire from reaching the fuel supply storage bin should fuel combustion travel from burner 22 down horizontal conduit 62 toward the fuel supply storage bin. The vertical height of safety tube 64 should be about or above five inches, and the rate of fuel supply traveling in both inclined conduit 58 and horizontal conduit 62 should be equivalent to prevent safety tube 64 from becoming full of pelletized fuel.

When transported, pelletized fuel falls down vertical safety tube 64 onto an extension of horizontal auger 60 which is enclosed within horizontal conduit 62. Rotation of horizontal auger 60 transports the fuel horizontally from the bottom of safety tube 64 to fuel receiving opening 36 wherein the fuel enters burner 22.

The air supplying means comprises: an air supply manifold; a delivery tube 70; and a combustion air blower 72. The air supply manifold extends at least partially about the periphery of burner 22 to encompass tuyeres 38. The air supply manifold defines the outer boundaries of a peripheral air passage 73. The air supply manifold includes a top peripheral edge 74 and a downwardly spaced bottom peripheral edge 76 which are integrally connected to the outer side walls 78 of burner 22. Top and bottom peripheral edges 74, 76 are joined by a substantially upright peripheral side wall 80. The air supply manifold receives air supplied through delivery tube 70.

Delivery tube 70 leads from open communication with peripheral air passage 73 to a high pressure outlet of powered combustion air blower 72. The inlet of combustion air blower 72 is exposed to the ambient atmosphere outside the airtight secondary combustion structure, and heat exchanger 26 if one is used. Operation of combustion air blower 72 forces air into the air supply manifold, thereby causing the forced air plenum discussed above. In the preferred embodiment, delivery tube 70, having about an eight-inch diameter, is coaxially positioned around the outside surfaces of serpentine fuel conduit 54 to partially encompass horizontal conduit 62 and communicate with the air supply manifold. Delivery tube 70 is securely attached to combustion air blower 72 such that, when combustion air blower 72 is operated, a continuous supply of pressurized air is forced along delivery tube 70 into peripheral air passage 73 of the air supply manifold and into the primary burning zone of burner 22 through tuyeres 38.

The rate of fuel consumption can be partially regulated by controlling the rate at which the combustion air is injected into burner 22. An air controlling means may be provided along delivery tube 70, or alternatively, may be provided at combustion air blower 72, to selectively control the amount of air being forced into peripheral air passage 73 of the air supply manifold.

Burner 22 is located within the airtight secondary combustion structure of furnace 20. The secondary combustion structure serves as the main structural framework of furnace 20 to capture and temporarily contain the ash, heat, exhaust, and hot combustible gases produced by the oxidation of fuel which escape from burner 22 through perforations 52. The secondary combustion structure also serves as a heat reservoir. The combustible gases further oxidize as they pass through the secondary combustion structure, and the waste exhaust is finally expelled outside of the building to the outside atmosphere. The secondary combustion structure may comprise the use of multiple combustion chambers in which primary combustion occurs within the lower, primary combustion chamber 24. Secondary combustion also occurs within primary combustion chamber 24, and possibly within a secondary combustion chamber 82 or a tertiary combustion chamber. Passing the combustible gases through the multiple combustion chambers of the secondary combustion structure is important to maximize the amount of heat obtained from the supplied fuel and to reduce the carbon monoxide levels being expelled from furnace 20. The combined features of the present invention contribute to a very high net efficiency of thermal conversion of the burning fuel, and dramatically assist the user in complying with very rigid air pollution quality standards. Another result is a marked absence of visible smoke emitted from furnace 22.

Sufficient time for combustion of the combustible gases is provided by the size and serpentine interconnection of the combustion chambers. Each combustion chamber should be sufficiently large enough to permit substantial further combustion of the combustible gases therein. In the preferred embodiment, primary combustion chamber 24 comprises a horizontal, elongated cylinder made from about a twenty-four-inch length of pipe having an appropriately sized diameter of about 10 to 12 inches and an extra heavy wall thickness of about one-fourth inch. Secondary combustion chamber 82 may be made from about a twenty-inch length of pipe having an appropriately sized diameter of about six-inches and a wall thickness of about one-fourth inch.

Figure 2:
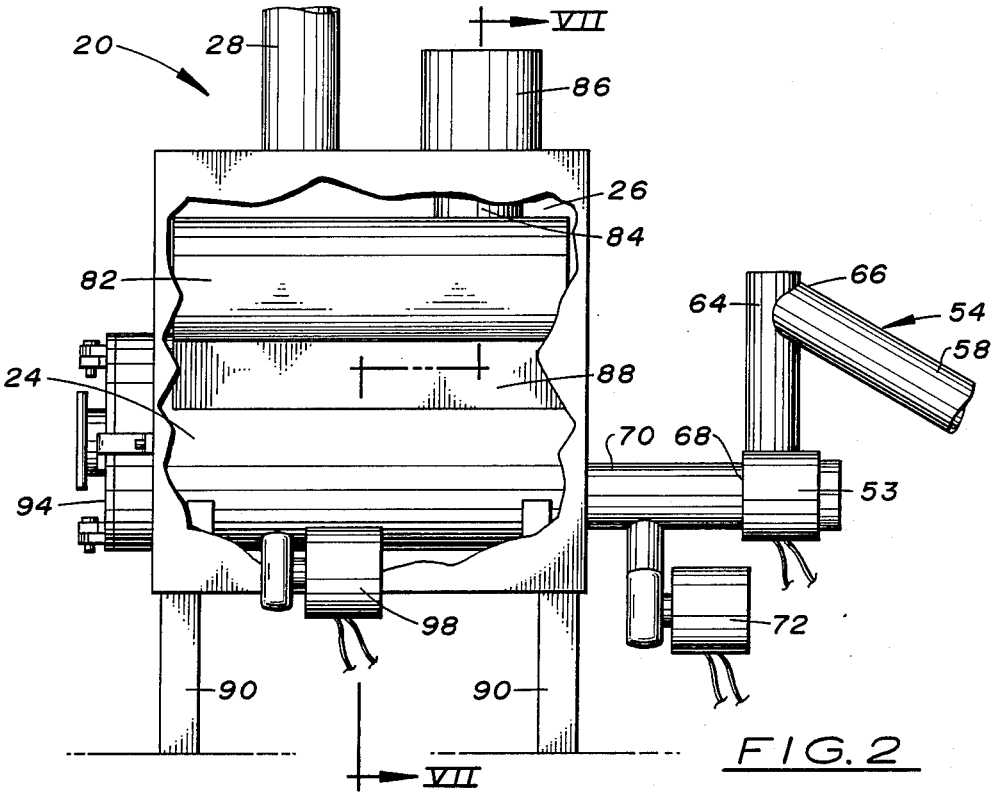
FIG. 2 is a side elevational view of the present invention as shown in FIG. 1 with a portion of the outer wall of the heat exchanger broken away.
Figure 3:
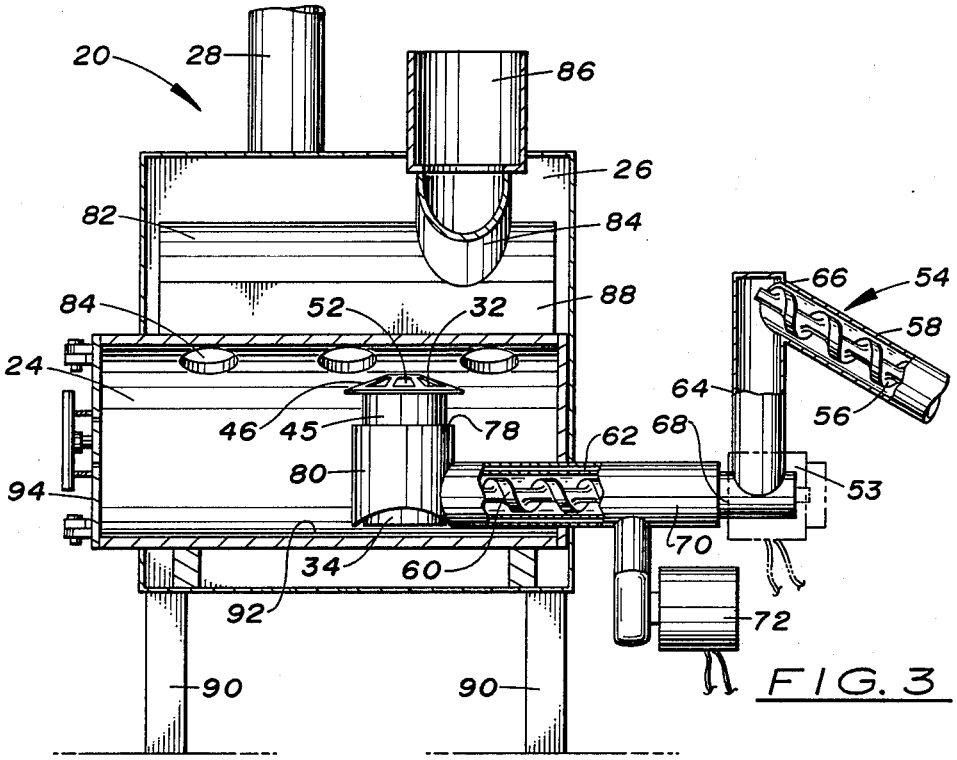
FIG. 3 is a cross-sectional view of the invention taken along line III—III of FIG. 7.

The preferred embodiment of the secondary combustion structure, as shown in FIGS. 1–3, utilizes a pair of secondary combustion chambers 82. Each secondary combustion chamber 82 receives combustible gases from primary combustion chamber 24 through flue pipes 84 and jointly vents waste exhaust gases through inverted Y-shaped chimney 86 to the outside atmosphere.

In another embodiment, there may be three combustion chambers serially connected, with primary and secondary combustion taking place in the lower, primary combustion chamber 24. Further secondary combustion takes place in a slightly higher, secondary combustion chamber 82 which is located in close proximity to primary combustion chamber 24. Even further secondary combustion may take place in a third and uppermost, tertiary combustion chamber. Primary, secondary, and the tertiary combustion chambers 24, 82, are interconnected in a serpentine manner by flue pipes 84. In this embodiment, the connection of flue pipes 84 between primary and secondary combustion chambers 24, 82 occurs near the back of furnace 20. Connection of flue pipes 84 between secondary and tertiary combustion chambers 82 would then occur near the front of furnace 20. Waste exhaust gases escape from within tertiary combustion chamber through chimney 86 located near the back of furnace 20 which are then passed into the outside atmosphere. If the tertiary combustion chamber is not used, chimney 86 is connected to secondary combustion chamber 82.

Operation of furnace 20 should not be affected by outside weather conditions, which usually occurs when furnace 20 is solely dependent upon convection currents to circulate the air through the secondary combustion structure. The air supplying means forces a controlled circulation of the air into burner 22 and the secondary combustion structure. Ambient air is first drawn at a preselected rate through combustion air blower 72 and is injected into the primary burning zone of burner 22 through tuyeres 38. The forced air plenum, caused by the injection of air into burner 22 and the expansion of the heated air within the secondary combustion structure, produces a substantially constant, controllable pressure differential between the area confined by the secondary combustion structure and the outside atmosphere. The forced air plenum both supports combustion within burner 22 and facilitates movement of the combustible gases through the secondary combustion structure to the outside atmosphere. The elevated pressure within the secondary combustion structure also induces further oxidation of the combustible gases than would normally occur at ambient pressure. Eventually, the pressurized waste exhaust gases are forced to exit the secondary combustion structure through chimney 86 which discharges the waste exhaust gases outside the associated building. In the preferred embodiment, no additional oxygen is injected into secondary combustion chamber 82 or the tertiary combustion chamber other than the pressurized air supplied by combustion air blower 72.

The positioning of flue pipes 84 and chimney 86 requires the combustible gases to pass through a substantial portion of the primary, secondary, and tertiary combustion chambers 24, 82, before being expelled to the outside atmosphere. Such positioning maximizes the ability of furnace 20 to oxidize the combustible gases emitted from within burner 22, and to transfer the produced heat to the heat-absorbing metal, forming the secondary combustion structure. Flue pipes 84 may serve as structural supports to support the attached combustion chambers within the secondary combustion structure. Additional supports 88 may be used to provide further structural support for the combustion chambers. Floor supports 90 or stands may also be used to elevate the combustion chambers or heat exchanger 26 away from combustible floors.

Primary combustion chamber 24 also serves as an ash pit 92. In the preferred embodiment, baffle 46 has a substantial overhang which directs the expelled ash to fall away from burner 22 and prevent ashes from accumulating on the sides of perforated baffle 46 which possibly could fall back into the primary burning zone of burner 22 and smother the flame. Ash pit 104 is located below burner 22 to receive the ashes which are expelled from out of perforations 52 in perforated baffle 46. Experimentation with the present invention has shown that very little ash is produced because of the substantially complete oxidation of supplied fuel within burner 22. An appropriate access door 94 may be formed in primary combustion chamber 24 to allow physical access to burner 22 and ash pit 92 for maintenance of furnace 20 and for removal of any deposited ash.

Heat exchanger 26 may be provided about the secondary combustion structure to contain and centralize the heat emitted from the secondary combustion structure. The air within heat exchanger 26 is in thermal contact with the outer surfaces of the secondary combustion structure and absorbs heat therefrom. Heat exchanger 26 collects the heated air and conveys it to a heat duct 28 where it may be passed into a conventional heat distribution system of a residential or commercial building having a central heating system. Heat exchanger 26 may use either convection currents or pressurized air to circulate the air about the exterior surfaces of the secondary combustion structure and to force the heated air into heat duct 28.

In the preferred embodiment, a circulation air blower 98 creates a circulation air plenum which forces pressurized air between heat exchanger 26 and the secondary combustion structure. Circulation air blower 98 forces cool air enter the circulation air plenum at a location near the bottom of heat exchanger 26. The pressurized cool air moves through heat exchanger 26 against the outer portions of the secondary combustion structure, wherein the cooler air absorbs the radiant heat emitted from the secondary combustion structure. Finally, the pressurized, heated air is forced to exit heat exchanger 26 through the discharge heat duct 28 located adjacent the top of heat exchanger 26.

In compliance with the statue, the invention has been described in language generally specific as to structural features. Since the means and construction herein disclosed comprise the preferred form of putting the invention into effect, it is to be understood the invention is not limited to the specific features shown herein. The invention is claimed in any of its forms or modifications within the legitimate and valid scope of the appended claims, appropriately interpreted in accordance with the doctrine of equivalents.

INDUSTRIAL APPLICABILITY

This furnace is particularly adapted for the effective burning of pelletized or particulate fuel as is often needed to heat residential or commercial buildings. By injecting pressurized air into the fuel, well below the top opening of the burner, the fuel burns at extremely elevated temperatures. The elevated temperatures oxidize substantially all solid, combustive portions of the fuel before the fuel reaches the open upper end of the burner. A perforated baffle assists the efficiency of the furnace by preventing the escape of non-consumed portions of solid fuel from the burner and reflects emitted heat back into the burner to increase the burning temperature therein. Multiple combustion chambers are used to oxidize the combustible gases and expel the remaining exhaust to the outside atmosphere. The heat created within the furnace is collected within a heat exchanger, wherein air is circulated past the multiple combustion chambers, and is passed into a heat duct where the heated air may then be distributed into residential or commercial air circulation systems.

I claim:

1. A furnace for burning combustible pelletized or particulate fuel, comprising:

(a) an upright, elongated burner defining a receptacle wherein said fuel is burnt, said burner having a lower bottom end and an open upper end, said burner having a fuel receiving opening near said lower bottom end, said burner having at least one tuyere formed therein, said tuyere being positioned substantially below said upper end, said burner having a perforated baffle positioned upon and partially closing said upper end for substantially retaining said fuel within said burner, said perforated baffle having means allowing ash, heat, exhaust, and combustible gases to escape from within said burner while reflecting heat back into said burner thereby increasing the combustion temperature in said burner, and causing expelled ash to fall away from said burner;

(b) fuel conveying means for delivering metered quantities of said fuel from a fuel supply storage bin into said burner through said fuel receiving opening, said burner having a fuel baffle located near said bottom end forcing said fuel being delivered to said burner upwardly into a combustion zone;

(c) air supplying means having an air supply manifold extending at least partially about the periphery of said burner to partially enclose said tuyere, said air supplying means producing a combustion air plenum within said air supply manifold such that air is forced through said tuyere into said burner to induce combustion within said burner; and (d) a primary combustion chamber, said burner being enclosed within said primary combustion chamber.

2. The furnace of claim 1, wherein said burner includes a tuyere ring and a retaining ring to hold and retain said fuel during combustion, said retaining ring being located immediately below said perforated baffle, said tuyere ring being located immediately below said retaining ring, said tuyere ring having said tuyere located therein.

3. The furnace of claim 2, wherein said retaining ring is removably attached to said tuyere ring.

4. The furnace of claim 1, wherein said fuel conveying means includes a serpentine fuel conduit wherein said fuel is dropped through a safety tube, thereby preventing combustion of said fuel from traveling through said fuel conveying means into said fuel supply storage bin.

5. The furnace of claim 1, wherein said combustion air supplying means includes a powered combustion air blower for forcing air into said air supply manifold, through said tuyere, and into said burner.

6. The furnace of claim 2, wherein said air supply manifold substantially encompasses said tuyere ring, said tuyere ring having a plurality of said tuyeres.

7. The furnace of claim 1, wherein said combustion air supplying means includes an air controlling means for selectively controlling the amount of air passing through said tuyeres into said burner.

8. The furnace of claim 1, further comprising a secondary combustion structure for capturing said heat, combustible gases, exhaust, and ash escaping from said burner during combustion of said fuel, said secondary combustion structure having:

(a) said primary combustion chamber enclosing said burner;

(b) at least one secondary combustion chamber communicating with said primary combustion chamber through at least one flue pipe, said combustible gases passing from said primary combustion chamber into said secondary combustion chamber through said flue pipe;

(c) a chimney communicating with said secondary combustion chamber, said combustible gases passing from said secondary combustion through said chimney to outdoor atmosphere.

9. The furnace of claim 8, wherein said primary combustion chamber has an access door.

10. The furnace of claim 8, further comprising a heat exchanger positioned about said secondary combustion structure.

11. The furnace of claim 10, wherein said heat exchanger includes a pressurized air circulation system wherein a circulation air plenum is created between said heat exchanger and said secondary combustion structure by a circulation air blower, said circulation air blower forcing air to move against said secondary combustion structure to absorb heat therefrom.

12. A furnace for burning combustible pelletized or particulate fuel, comprising:

(a) an upright, elongated burner defining a receptacle wherein said fuel is burnt, said burner having a lower bottom end and an open upper end, said burner having a fuel receiving opening near said lower bottom end, said burner having at least one tuyere formed therein, said tuyere being positioned substantially below said upper end, said burner having a conical perforated baffle positioned upon and partially closing said upper end for substantially retaining said fuel within said burner, said perforated baffle allowing ash, heat, exhaust, and combustible gases to escape from within said burner while reflecting heat back into said burner thereby increasing the combustion temperature in said burner;

(b) fuel conveying means for delivering metered quantities of said fuel from a fuel supply storage bin into said burner through said fuel receiving opening, said burner having a fuel baffle located near said bottom end for forcing said fuel being delivered to said burner upwardly into a combustion zone;

(c) air supplying means having an air supply manifold extending at least partially about the periphery of said burner to partially enclose said tuyere, said air supplying means producing a combustion air plenum within said air supply manifold such that air is forced through said tuyere into said burner to induce combustion within said burner; and (d) a primary combustion chamber, said burner being enclosed within said primary combustion chamber.

13. A furnace for burning combustible pelletized or particulate fuel, comprising:

(a) an upright, elongated burner defining a receptacle wherein said fuel is burnt, said burner having a lower bottom end and an open upper end, said burner having a fuel receiving opening near said lower bottom end, said burner having at least one tuyere formed therein, said tuyere being positioned substantially below said upper end, said burner having a perforated baffle positioned upon and partially closing said upper end for substantially retaining said fuel within said burner, said perforated baffle allowing ash, heat, exhaust, and combustible gases to escape from within said burner while reflecting heat back into said burner thereby increasing the combustion temperature in said burner;

(b) fuel conveying means for delivering metered quantities of said fuel from a fuel supply storage bin into said burner through said fuel receiving opening, said burner having a fuel baffle located near said bottom end for forcing said fuel being delivered to said burner upwardly into a combustion zone;

(c) air supplying means having an air supply manifold extending at least partially about the periphery of said burner to partially enclose said tuyere, said air supplying means producing a combustion air plenum within said air supply manifold such that air is forced through said tuyere into said burner to induce combustion within said burner; and (d) a primary combustion chamber, said burner being enclosed within said primary combustion chamber;

(e) a pair of secondary combustion chambers, each receiving combustible gases directly from said primary combustion chamber through a flue pipe, said secondary combustion chambers jointly venting waste exhaust through an inverted Y-shaped chimney.

14. The furnace of claim 13, wherein said pair of secondary combustion chambers are symmetrically positioned about said primary combustion chamber.

15. The furnace of claim 13, wherein said secondary combustion chambers are at least partially supported by said flue pipe.

* * * * *